US010438525B2

(12) United States Patent
Yeon et al.

(10) Patent No.: US 10,438,525 B2
(45) Date of Patent: Oct. 8, 2019

(54) METHOD OF CONTROLLING DISPLAY OF ELECTRONIC DEVICE AND ELECTRONIC DEVICE THEREOF

(71) Applicant: SAMSUNG ELECTRONICS CO., LTD., Suwon-si, Gyeonggi-do (KR)

(72) Inventors: Hun-Je Yeon, Seoul (KR); So-Young Youn, Seoul (KR); Min-Ji Park, Gwangmyeong-si (KR); Woo-Jin Park, Yongin-si (KR); Moon-Ki Hong, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 435 days.

(21) Appl. No.: 14/809,758

(22) Filed: Jul. 27, 2015

(65) Prior Publication Data

US 2016/0078795 A1 Mar. 17, 2016

(30) Foreign Application Priority Data

Sep. 12, 2014 (KR) ..... 10-2014-0120861

(51) Int. Cl.
*G09G 3/20* (2006.01)

(52) U.S. Cl.
CPC ..... *G09G 3/20* (2013.01); *G09G 2320/0686* (2013.01); *G09G 2330/021* (2013.01);
(Continued)

(58) Field of Classification Search
CPC ..... G09G 3/20; G09G 2330/021; G09G 2330/022; G09G 2330/027; G09G 5/10; G09G 2320/0626; G09G 2340/0407; G06F 1/163; G06F 1/1694; G06F 1/3206; G06F 1/3237; G06F 1/325; G06F 1/3265; G06F 2200/1637; G06F 1/3218; Y02D 10/128;
(Continued)

(56) References Cited

U.S. PATENT DOCUMENTS 5,548,764 A * 8/1996 Duley ..... G06F 1/3209 713/310
7,123,215 B2 * 10/2006 Nakada ..... G02B 27/017 345/8
(Continued)

FOREIGN PATENT DOCUMENTS

KR 10-2008-0048223 6/2008
KR 10-2011-003664 1/2011
(Continued)

OTHER PUBLICATIONS

Search Report dated Nov. 26, 2015 in counterpart International Application No. PCT/KR2015/008559.
(Continued)

*Primary Examiner* — Bryan Earles
(74) *Attorney, Agent, or Firm* — Nixon & Vanderhye P.C.

(57) ABSTRACT

Disclosed is a method of controlling a display of an electronic device. The method may include: determining a current situation of the electronic device by using at least one piece of state information on the electronic device and surrounding information on the electronic device by the electronic device; and turning on or off at least some areas of the display according to the determined current situation by the electronic device.

14 Claims, 8 Drawing Sheets

(52) U.S. Cl.
CPC . *G09G 2330/022* (2013.01); *G09G 2330/027* (2013.01); *G09G 2354/00* (2013.01); *G09G 2360/144* (2013.01); *G09G 2380/02* (2013.01)

(58) Field of Classification Search
CPC ..... Y02D 10/153; Y02D 50/20; H04N 5/74; G02B 27/017; G02B 27/0093; G02B 2027/0178; G06T 19/006
USPC ..... 345/156
See application file for complete search history.

(56) References Cited

U.S. PATENT DOCUMENTS 8,593,427 B1 11/2013 Yang et al.
9,075,568 B1 * 7/2015 Gray ..... G06F 1/1626
2005/0221798 A1 10/2005 Sengupta et al.
2011/0037576 A1 2/2011 Jeon et al.
2012/0127218 A1 5/2012 Son
2012/0169608 A1 7/2012 Forutanpour et al.
2012/0235790 A1 * 9/2012 Zhao ..... G06F 21/32 340/5.83
2012/0242560 A1 * 9/2012 Nakada ..... G09G 3/3406 345/8
2012/0316777 A1 * 12/2012 Kitta ..... G01C 21/3661 701/431
2013/0162502 A1 6/2013 Lee et al.
2013/0178248 A1 * 7/2013 Kim ..... H04M 1/0268 455/566
2013/0198392 A1 * 8/2013 Hymel ..... G06F 3/013 709/227
2013/0265243 A1 10/2013 Law
2014/0176456 A1 6/2014 Yoon
2014/0273849 A1 * 9/2014 Lee ..... G06F 1/1694 455/41.2
2014/0325614 A1 * 10/2014 Rhelimi ..... H04W 12/06 726/4
2014/0366123 A1 * 12/2014 DiBona ..... G06F 21/60 726/16
2015/0011199 A1 * 1/2015 Lee ..... H04M 1/7253 455/418
2015/0015502 A1 * 1/2015 Al-Nasser ..... G04G 17/08 345/173
2015/0278498 A1 * 10/2015 Hong ..... G06F 21/32 340/5.82
2016/0026211 A1 * 1/2016 Luna ..... G06F 1/163 361/679.03
2016/0071488 A1 * 3/2016 Shen ..... G06F 3/017 345/589
2017/0083148 A1 * 3/2017 Ahn ..... H04M 1/7253

FOREIGN PATENT DOCUMENTS

KR 10-2011-0097605 8/2011
KR 10-2012-0034491 4/2012
WO 2011/063516 6/2011

OTHER PUBLICATIONS

Written Opinion dated Nov. 26, 2015 in counterpart International Application No. PCT/KR2015/008559.
EP Search Report for EP Application No. 15839764.6 dated Jan. 26, 2018.
Communication pursuant to Article 94(3) EPC dated Nov. 26, 2018 in counterpart European Patent Application No. 15839764.6.

* cited by examiner

METHOD OF CONTROLLING DISPLAY OF ELECTRONIC DEVICE AND ELECTRONIC DEVICE THEREOF

CROSS-REFERENCE TO RELATED APPLICATION

This application is based on and claims priority under 35 U.S.C. § 119 to Korean Application Serial No. 10-2014-0120861, which was filed in the Korean Intellectual Property Office on Sep. 12, 2014, the content of which is hereby incorporated by reference in its entirety.

TECHNICAL FIELD

The present disclosure relates to a method of controlling a display of an electronic device to reduce power consumption of the electronic device, and an electronic device thereof.

BACKGROUND

A display of an electronic device such as a smart phone or a tablet Personal Computer (PC) typically includes a screen display device, which visually displays data, and the use of a touch screen equipped with a touch panel is also known.

According to the general conventional display technology, an entirety of the display of the electronic device is turned on or off according to a user's control or turned on when a particular event is generated in the electronic device and an alarm of the generated event is displayed in a predetermined area. Further, a technology for turning on some areas of the display when the electronic device is equipped with an auxiliary device such as a cover has been already developed.

SUMMARY

In the conventional art, a display of an electronic device is in an on state even when a user using the electronic device does not view a display screen of the electronic device or does not use the electronic device, which results in a waste of power of the electronic device.

Further, an entire area of a display of the conventional electronic device is in an on state even when there is no need to use the entire area of the display, thereby wasting power of the electronic device.

Accordingly, various example embodiments may provide a display control method for an electronic device and an electronic device thereof for allowing a user to identify required information by turning on or off portions of a display of the electronic device to match a situation of the electronic device and the user using the electronic device.

Various example embodiments may provide a display control method for an electronic device and an electronic device thereof for increasing efficiency of the power use of the electronic device by minimizing and/or reducing an output time and an output area of a display screen of the electronic device based on a situation of the electronic device and the user using the electronic device.

Various example embodiments may provide a display control method for an electronic device and an electronic device thereof for determining a situation of the electronic device and the user using the electronic device through various sensors included in the electronic device.

In accordance with an example aspect, a method of controlling a display of an electronic device is provided. The method may include: determining a current situation of the electronic device based on at least one piece of information of the electronic device, the information including at least one of a state information of the electronic device and surrounding information of the electronic device; and turning on or off portions of the display according to the determined current situation.

In accordance with another example aspect, an electronic device is provided. The electronic device may include: a display; a sensor module that detects at least one piece of information of the electronic device, the at least one piece of information including at least one of state information and surrounding information of the electronic device; and a controller configured to determine a current situation of the electronic device based on the at least one piece of the information detected through the sensor module and to turn on or off portions of the display based on the determined current situation.

A display control method for an electronic device and an electronic device thereof according to various example embodiments may allow a user to identify required information by turning on or off at least portions of a display of the electronic device to match a situation of the electronic device and the user using the electronic device.

A display control method for an electronic device and an electronic device thereof according to various example embodiments can increase efficiency of power use of the electronic device by minimizing and/or reducing an output time and an output area of a display screen of the electronic device to match a situation of the electronic device and the user using the electronic device.

A display control method by an electronic device and an electronic device thereof according to various example embodiments may determine a situation of the electronic device and a user using the electronic device through various sensors that may be included in the electronic device.

BRIEF DESCRIPTION OF THE DRAWINGS

The above and other aspects, features, and advantages of the example embodiments will be more apparent from the following detailed description taken in conjunction with the accompanying drawings, in which like reference numerals refer to like elements, and wherein.

DETAILED DESCRIPTION

Figure 1:
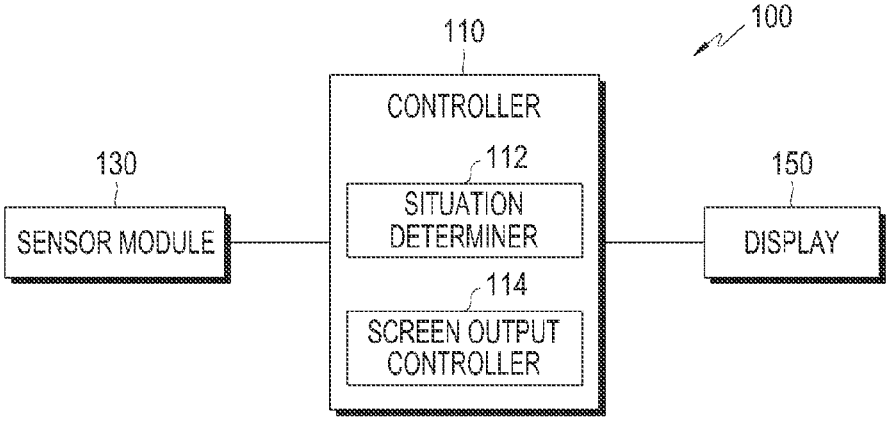
FIG. 1 is a block diagram of an electronic device according to an example embodiment.

The present disclosure may be modified in various forms and include various example embodiments, but specific examples are illustrated in the drawings and described herein. However, it should be understood that there is no intent to limit the present disclosure to the particular forms disclosed herein; rather, the present disclosure should be construed to cover all modifications, equivalents, and/or alternatives falling within the spirit and scope of the disclosure. In the description of the drawings, identical or similar reference numerals are used to designate identical or similar elements.

Hereinafter, the terms "include" or "may include", which may be used in various example embodiments, refer to the presence of disclosed functions, operations or elements, and do not restrict the addition of one or more functions, operations or elements. In the present disclosure, the terms such as "include" or "have" may be construed to denote a certain characteristic, number, step, operation, constituent element, component or a combination thereof, but may not be construed to exclude the existence of or a possibility of addition of one or more other characteristics, numbers, steps, operations, constituent elements, components or combinations thereof.

In various example embodiments, the expression "or" or "at least one of A and/or B" includes any or all of combinations of words listed together. For example, the expression "A or B" or "at least A and/or B" may include A, may include B, or may include both A and B.

The expressions such as "first," "second," or the like used in various example embodiments may modify various component elements in the various example embodiments but may not limit corresponding component elements. For example, the above expressions do not limit the sequence and/or importance of the elements. The above expressions are used merely for the purpose of distinguishing an element from other elements. For example, a first user device and a second user device indicate different user devices although both of them are user devices. For example, without departing from the scope of the present disclosure, a first component element may be named a second component element. Similarly, the second component element also may be named the first component element.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

The terms in various example embodiments are used to describe a specific embodiment, and are not intended to limit the present disclosure. As used herein, the singular forms are intended to include the plural forms as well, unless the context clearly indicates otherwise.

Unless defined differently, all terms used herein, which include technical terminologies or scientific terminologies, have the meaning that understood by a person skilled in the art to which the present disclosure belongs. Such terms as those defined in a generally used dictionary are to be interpreted to have the meanings equal to the contextual meanings in the relevant field of art, and are not to be interpreted to have ideal or excessively formal meanings unless clearly defined in the present disclosure.

An electronic device according to various example embodiments may be a device with a communication function. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory, an electronic tattoo, or a smart watch), or the like.

According to some example embodiments, the electronic device may be a smart home appliance with a communication function. The smart home appliance as an example of the electronic device may include at least one of, for example, a television, a Digital Video Disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic picture frame, or the like.

According to some example embodiments, the electronic device may include at least one of various medical devices such as a magnetic resonance angiography (MRA) scanner, a magnetic resonance imaging (MRI) scanner, a computed tomography (CT) scanner, a scanner, an ultrasonograph, or the like, a navigation device, a Global Positioning System (GPS) receiver, an Event Data Recoder (EDR), a Flight Data Recoder (FDR), a vehicle infotainment device, an electronic equipment for ship (for example a ship navigation device and gyro-compass or the like, avionics, a security device, a head unit for vehicle, an industrial or household robot, ATM (automatic teller machine) in banking facilities or POS (point of sales) in stores, or the like.

According to some example embodiments, the electronic device may include at least one of furniture or a part of a building/structure, an electronic board, an electronic signature receiving device, a projector, and various types of measuring devices (for example, a water meter, an electric meter, a gas meter, a radio wave meter and the like) including a camera function. An electronic device according to various example embodiments may be a combination of one or more of above described various devices. Also, an electronic device according to various example embodiments may be a flexible device. Also, an electronic device according to various example embodiments is not limited to the above described devices.

The term "user" used in various example embodiments may refer to a person who uses an electronic device or a device (for example, an artificial intelligence electronic device) that uses an electronic device.

FIG. 1 is a block diagram of an electronic device according to an example embodiment. Referring to FIG. 1, the electronic device 100 may include a controller 110, a sensor module 130, and a display 150.

The sensor module 130 may detect at least one piece of state information of the electronic device 100 and surrounding information of the electronic device 100.

The sensor module 130 may, for example, include an illumination sensor for detecting surrounding illumination of the electronic device 100, a proximity sensor for detecting proximity of an object (user) approaching the electronic device 100, an acceleration sensor for measuring acceleration of the electronic device 100, a iris recognition sensor for recognizing the iris of a user using the electronic device 100, a GPS for measuring a position of the electronic device 100, or the like. Further, the sensor module 130 may, for example, detect whether the electronic device has a communication connection with an external device, for example, a wearable device. In addition, the sensor module 130 may, for example, include various sensors, which may measure the state information of the electronic device 100 and/or the surrounding information of the electronic device 100 as well as the above described sensors.

The display 150 may, for example, display execution images, operating states, menu states, and the like of various application programs, and may be implemented by a touch screen and a touch screen controller (not shown) which will be described below.

Further, according to an example embodiment, an area of the display 150 may be divided, for example, into at least two areas, and each of the areas may be turned on or off according to a control of the controller 110.

Meanwhile, the touch screen may, for example, receive an input of a user manipulation and display an execution image, an operating state, and/or a menu state of an application program. That is, the touch screen may provide a user with a user interface corresponding to various services (for example, a telephone call, data transmission, broadcasting, photographing, or the like). The touch screen may transmit a signal corresponding to at least one touch input to the user interface to the touch screen controller. The touch screen may receive one or more touches made by a user (for example, fingers including a thumb) or a touchable input means (also, referred to as a pen, for example, a stylus pen). Also, the touch screen may receive a continuous movement of one of the one or more touches. The touch screen may transmit a signal corresponding to the continuous movement of the touch input thereto to the touch screen controller.

The touch is not limited to direct contact between the touch screen and the user or the touchable input means, and may include non-contact. The distance which may be detected by the touch screen may change according to the capability or structure of the electronic device 100, and the touch screen may be especially configured to distinctively output a value detected through a touch event and a value detected through a hovering event (for example, a current value, or the like), in order to distinguish a touch event by contact with a body part of the user or a touchable input means, and a contactless input event, for example, a hovering event. In addition, the touch screen may differently output the detected value (for example, current value) according to a distance between a space where the hovering event is generated and the touch screen.

The touch screen may, for example, be implemented, for example, in a resistive type, a capacitive type, an infrared type, an acoustic wave type, or the like.

Meanwhile, the touch screen controller is configured to convert the signal received from the touch screen to, for example, a digital signal (for example, X and Y coordinates) and transmits the digital signal to the controller 110. The controller 110 may control the touch screen using the digital signal received from the touch screen controller. For example, the controller 110 allows a short-cut icon (not shown) displayed on the touch screen to be selected or executed in response to a touch event or a hovering event. Furthermore, the touch screen controller may also be included in the controller 110.

In addition, the touch screen controller may, for example, identify the distance between the space where the hovering event is generated and the touch screen by detecting a value (for example, current value) output through the touch screen, and may convert the identified distance value to a digital signal (for example, a Z coordinate) and provide the digital signal to the controller 110.

Moreover, the touch screen may include two or more touch screen panels which may detect a touch or proximity from the user or the touchable input means so as to simultaneously receive inputs by the user's body and the touchable input means. The two or more touch screen panels may provide different output values to the screen controller, and the touch screen controller may differently recognize the values input from the two or more touch screen panels to distinguish whether the input from the touch screen is an input by the user's body or an input by the touchable input means.

The controller 110 may, for example, include a Central Processing Unit (CPU, not shown), a Read Only Memory (ROM, not shown) storing a control program for controlling the electronic device, and a Random Access Memory (RAM, not shown) which stores signals or data input from the outside of the electronic device or is used as a storage region for tasks performed by the electronic device. The CPU (not illustrated) may include a single core CPU, a dual core CPU, a triple core CPU, a quad core CPU, or the like. The CPU (not shown), the ROM (not shown) and the RAM (not shown) may be connected to each other through an internal bus.

Further, the controller 110 may control the sensor module 130 and the display 150.

In addition, the controller 110 may include a situation determiner 112 and a screen output controller 114.

The situation determiner 112 may, for example, determine a current situation of the electronic device 100 by using at least one piece of state information of the electronic device 100 and surrounding information of the electronic device 100 detected through the sensor module 130.

The state information of the electronic device 100 may, for example, include position information of the electronic device 100 collected through a sensor for detecting a position of the electronic device 100 such as the GPS receiver. The state information of the electronic device 100 may include motion information of the electronic device 100 collected through a sensor for detecting a motion of the electronic device 100 such as an acceleration sensor. Further, the state information of the electronic device 100 may be information on whether the user of the electronic device 100 views the display 150 of the electronic device 100 through, for example, the iris recognition sensor. In addition, the state information of the electronic device 100 may be information indicating, when a particular event is generated in the electronic device 100. Moreover, the state information of the electronic device 100 may be information indicating, for example, a wired or wireless connection with an external device.

The surrounding information of the electronic device 100 may, for example, be surrounding illumination information of the electronic device 100 collected through, for example, an illumination sensor of the electronic device 100. Further, the surrounding information on the electronic device 100 may be information on a degree of proximity of an object (or person) approaching the electronic device 100, which is collected through, for example, a proximity sensor.

An operation for determining the current situation of the electronic device 100 may include, for example, determination of whether the electronic device 100 should use an entire area of the display of the electronic device 100, determination whether the electronic device 100 is not required to use the entire area of the display of the electronic device 100, and determination on whether the electronic device 100 may use only some areas of the display of the electronic device 100.

The situation where the electronic device 100 should use the entire area of the display 150 of the electronic device 100, the situation where the electronic device 100 is not required to use the entire area of the display 150 of the electronic device 100, and the situation where the electronic device 100 may use only some areas of the display 150 of the electronic device 100 may be predetermined when the electronic device 100 is manufactured or be defined according to a user's control. The situation where the electronic device 100 should use the entire area of the display 150 of the electronic device 100 may, for example, be a situation where the electronic device 100 is used by the user (for example, a situation where there is a control input by the user). Further, for example, the situation where the electronic device 100 is not required to use the entire area of the display 150 of the electronic device 100 may be a situation where the electronic device 100 is not used by the user or a situation where the electronic device is connected to an external device described below. For example, the situation where the electronic device 100 may use only some areas of the display 150 of the electronic device 100 may be a situation where a particular event is generated in the electronic device 100 described below.

The operation for determining the current situation of the electronic device 100 may be, for example, an operation for determining whether the electronic device 100 is used by the user through one piece of the above described information or a combination of one or more thereof. The situation where the electronic device 100 is not used by the user may, for example, be predetermined as the situation where the entire area of the display 150 should be used.

The operation for determining the current situation of the electronic device 100 may, for example, be an identification of the generation of an event in the electronic device 100 when the event is generated in the electronic device 100. The event may correspond to various events such as a phone call reception event, a message reception event, a preset schedule alarm event, a preset morning call alarm event, a low battery alarm event of the electronic device 100, an application update alarm event of the electronic device 100, or the like. The situation where the generation of the event in the electronic device 100 is identified may be predetermined as the situation where only some areas of the display 150 may be used.

The operation for determining the current situation of the electronic device 100 may, for example, be an identification of whether the electronic device 100 is connected to an external electronic device. When the event is generated in the electronic device 100, the electronic device 100 may identify whether the electronic device 100 is connected to the external device. The external device may, for example, be a wearable device such as smart glasses, a smart watch, or the like. The situation where it is identified that the electronic device 100 is connected to the external device may be predetermined as the situation where the electronic device 100 is not required to use the entire area of the display 150.

The operation for determining the current situation of the electronic device 100 may determine whether, for example, the electronic device 100 executes only a particular function (for example, an MP3 function) of the electronic device 100. The particular function may be predetermined when the electronic device 100 is manufactured or according to a user's control. The situation where the execution of the particular event by the electronic device 100 is identified may be predetermined as the situation where only some areas of the display 150 may be used.

The screen output controller 114 may control the display 150 to turn on or off at least some areas of the display 150 according to the current situation determined by the situation determiner 112. The screen output controller 114 may, for example, control an on or off time of at least some areas of the display 150 according to the current situation determined by the situation determiner 112.

Meanwhile, although not illustrated, the electronic device 100 may, for example, further include a communication module for transmitting/receiving a wireless signal to/from an external device (for example, a wearable device) according to a control of the controller 110.

Figure 2:
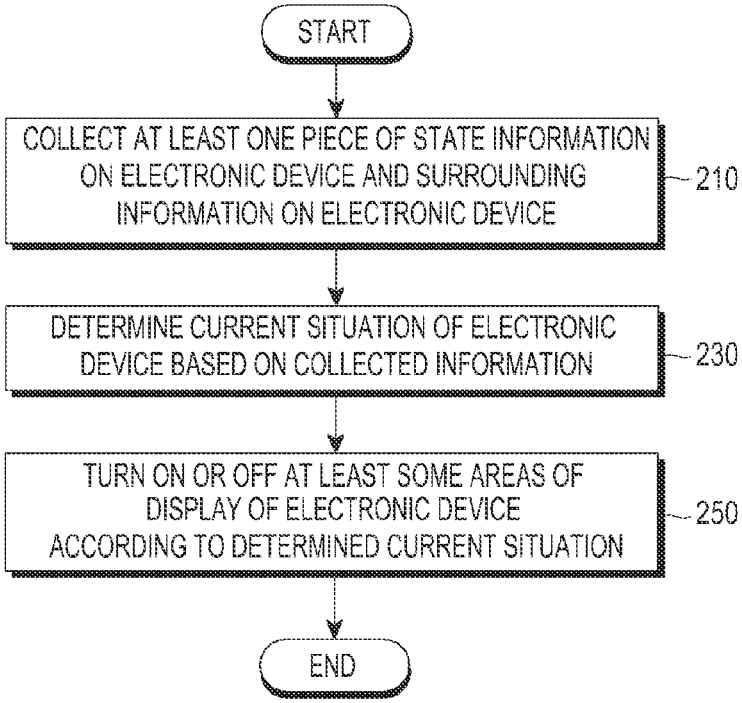
FIG. 2 is a flowchart illustrating a display control operation by an electronic device according to an example embodiment.

FIG. 2 is a flowchart illustrating a display control operation by the electronic device according to an example embodiment. Referring to FIG. 2, the electronic device may determine a current situation of the electronic device by using at least one piece of state information of the electronic device and/or surrounding information on the electronic device and may turn on or off at least some areas of the display according to the determined current situation.

In operation 210, the electronic device may collect at least one piece of the state information on the electronic device and the surrounding information of the electronic device. The collection of the information may be performed when a change in the state information of the electronic device and/or the surrounding information on the electronic device is detected. Further, the collection of the information may, for example, be performed on every cycle.

In operation 230, the electronic device may determine the current situation of the electronic device by using the collected information. For example, the electronic device may determine whether the current situation corresponds to a situation where the electronic device should use an entire area of the display of the electronic device, a situation where the electronic device is not required to use the entire area of the display of the electronic device, or a situation where the electronic device may use only some areas of the display of the electronic device.

In operation 250, the electronic device may turn on or off at least some areas of the display of the electronic device according to the determined current situation. For example, when the electronic device turns on at least some areas of the display of the electronic device, the electronic device may turn on at least some areas of the display only for a predetermined time corresponding to the current situation. The time may be determined when the electronic device is manufactured or according to a user's control.

For example, when the electronic device is not used by the user, it may be determined that the electronic device is not required to use the entire area of the display of the electronic device, and thus the electronic device may turn off the entire area of the display of the electronic device.

For example, when the event is generated in the electronic device, it may be determined that the electronic device may use only some areas of the display of the electronic device, and thus the electronic device may turn on only a predetermined area on the display of the electronic device corresponding to the event. Further, the electronic device may display an alarm of the event in the turned on area.

For example, when the event is generated in the electronic device and the electronic device is connected to the external device, it may be determined that the electronic device is not required to use the entire area of the display of the electronic device, and thus the electronic device may turn off the entire area of the display of the electronic device. Simultaneously, the electronic device may transmit information of the event to the external device, so as to allow the external device to display an alarm for the generation of the event.

Figure 3:
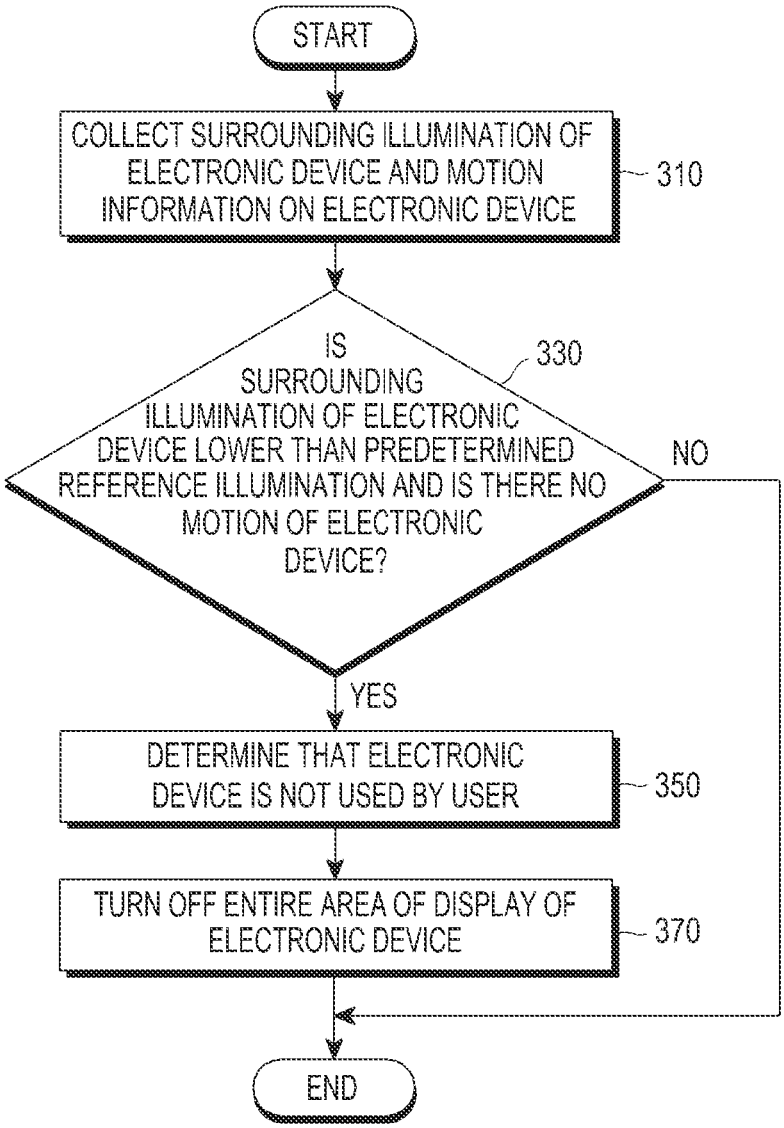
FIG. 3 is a flowchart illustrating a display control operation in a situation where an electronic device is not used by a user according to an example embodiment.

FIG. 3 is a flowchart illustrating a display control operation in a situation where the electronic device is not used by the user according to an example embodiment. Referring to FIG. 3, when the electronic device is not used by the user such as a situation where the user puts the electronic device having the turned on display into a user's pocket and is thus not held by a user's hand or a situation where the user places the electronic device having the turned on display such that the display faces down and the electronic device does not move, some sensors included in the electronic device may collect at least one piece of the state information of the electronic device and the surrounding information on the electronic device. The electronic device may determine whether the electronic device is being used by the user by using at least one piece of the collected information. When it is determined that the electronic device is not being used by the user, the electronic device may turn off the entire area of the display of the electronic device, thereby reducing unnecessary power consumption. For example, when surrounding illumination of the electronic device is lower than a predetermined reference illumination and there is no motion of the electronic device based on the motion information of the electronic device, the electronic device may determine that the electronic device is not being used by the user.

In operation 310, the electronic device may collect surrounding illumination information of the electronic device and motion information of the electronic device. The surrounding illumination of the electronic device may be collected using, for example, the illumination sensor of the electronic device. Further, the motion information of the electronic device may be collected using, for example, an acceleration sensor of the electronic device.

The electronic device may determine whether the surrounding illumination of the electronic device is lower than a predetermined reference illumination and there is no motion of the electronic device in operation 330. The electronic device may perform operation 350 when it is determined that the surrounding illumination of the electronic device is lower than the predetermined reference illumination and there is no motion of the electronic device (first condition) in operation 330, and may end the operation when it is determined that the first condition is not met in operation 330.

In operation 350, the electronic device may determine that the electronic device is not used by the user.

In operation 370, the electronic device may turn off the entire area of the display of the electronic device.

Figure 4:
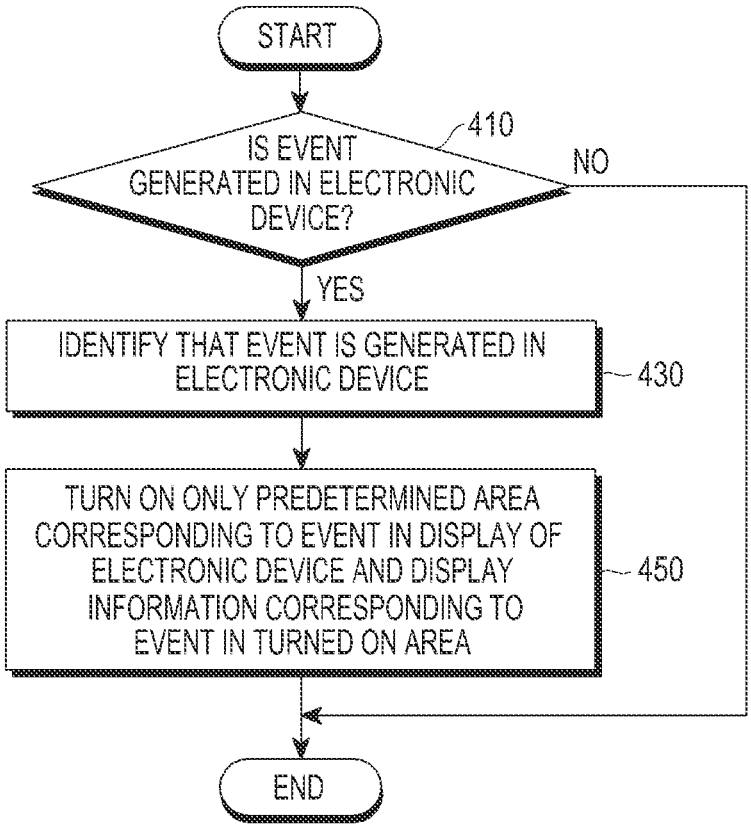
FIG. 4 is a flowchart illustrating a display control operation in an event generation situation according to an example embodiment.

FIG. 4 is a flowchart illustrating a display control operation in an event generation situation according to an example embodiment. Referring to FIG. 4, when an event is generated in the electronic device, the electronic device may identify the generation of the event in the electronic device and turn on only a predetermined area corresponding to the event on the display of the electronic device, so as to display information corresponding to the event in the turned on area.

In operation 410, the electronic device may determine whether the event is generated in the electronic device. The electronic device may perform operation 430 when it is determined that the event is generated in the electronic device in operation 410, and may end the operation when it is determined that the event is not generated in the electronic device in operation 410.

In operation 430, the electronic device may identify that the event is generated in the electronic device.

Figure 5:
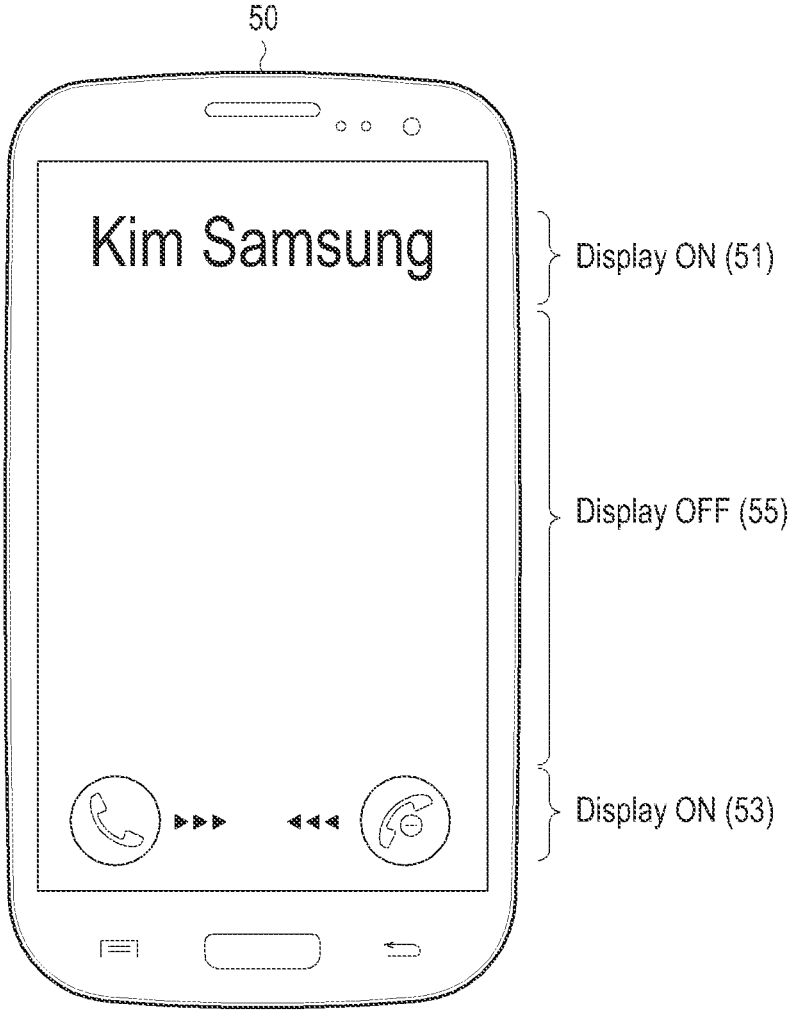
FIG. 5 illustrates a display screen in an event generation situation according to an example embodiment.

In operation 450, the electronic device may turn on only a predetermined area corresponding to the event on the display of the electronic device and display information corresponding to the event in the turned on area. For example, the electronic device identifies generation of a call reception event when the call reception event is generated in the electronic device, the electronic device 50 may turn on only some areas 51 and 53 of the display of the electronic device 50 corresponding to the call reception event and turn off the remaining area 55, so as to display information corresponding to the call reception event in the turned on areas 51 and 53 of the display as illustrated in FIG. 5.

Figure 6:
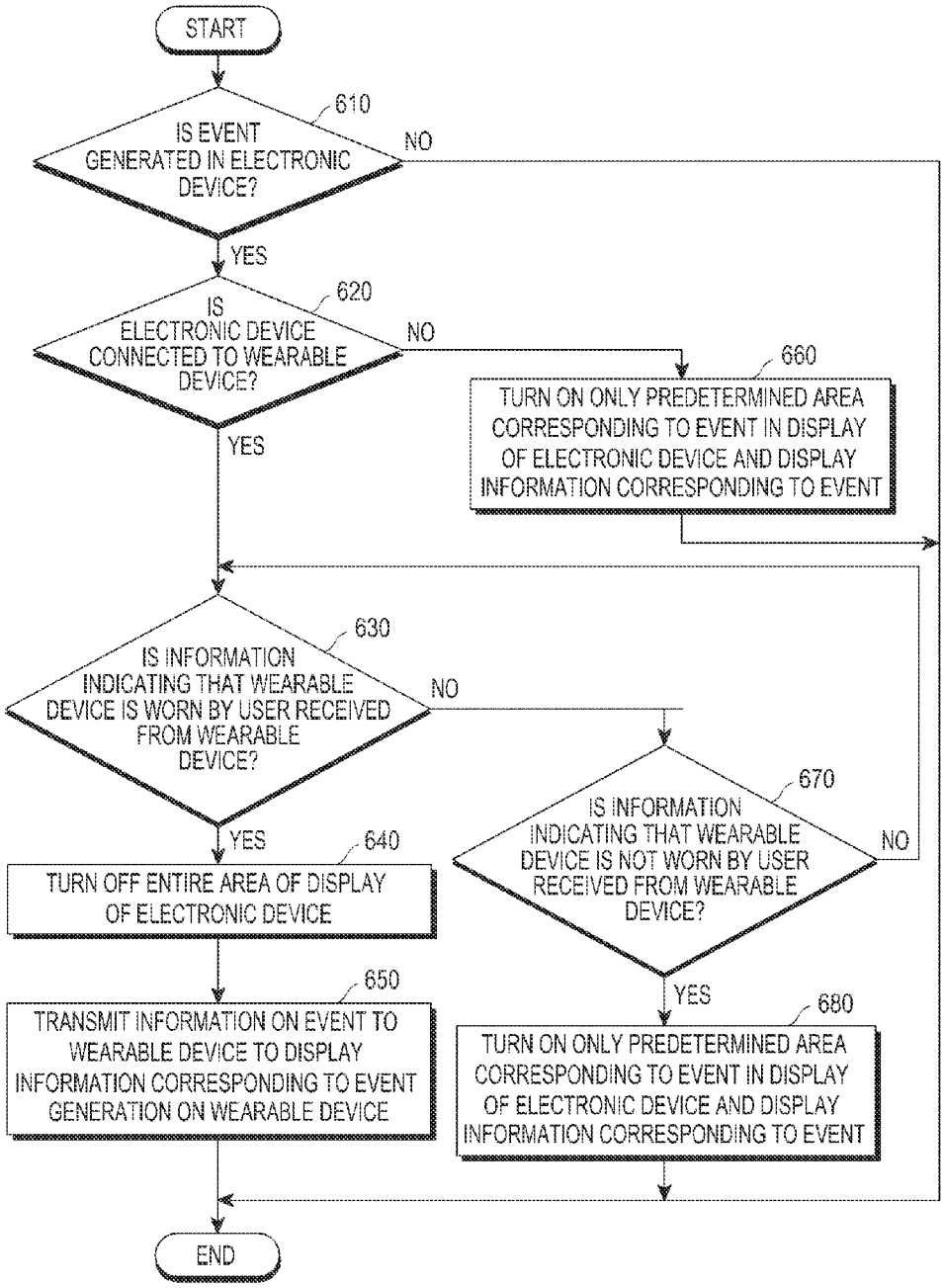
FIG. 6 is a flowchart illustrating a display control operation in a situation where an electronic device is connected to an external device according to an example embodiment.

FIG. 6 is a flowchart illustrating a display control operation in a situation where the electronic device is connected to an external device according to an example embodiment. Referring to FIG. 6, when an event is generated in the electronic device, the electronic device may determine whether the electronic device is connected to an external device, for example, a wearable device. When it is determined that the electronic device is connected to the wearable device, the electronic device may receive information from the wearable device on whether the wearable device is being worn by the user and turn off the entire area of the display of the electronic device.

In operation 610, the electronic device may determine whether the event is generated in the electronic device. The electronic device may perform operation 620 when it is determined that the event is generated in the electronic device in operation 610, and may end the operation when it is determined that the event is not generated in the electronic device in operation 610.

In operation 620, the electronic device may determine whether the electronic device is connected to the wearable device. The electronic device may perform operation 630 when it is determined that the electronic device is connected to the wearable device in operation 620, and may perform operation 660 when it is determined that the electronic device is not connected to the wearable device in operation 620.

In operation 630, the electronic device may determine whether the electronic device receives the information indicating that the wearable device is worn by the user from the wearable device. The electronic device may perform operation 640 when it is determined that the electronic device receives the information indicating that the electronic device is worn by the user in operation 630, and may perform operation 670 when it is determined that the electronic device does not receive the information indicating that the electronic device is worn by the user in operation 630.

In operation 640, the electronic device may turn off the entire area of the display of the electronic device.

In operation 650, the electronic device may transmit the information on the event to the wearable device to display the information corresponding to the generation of the event on the wearable device.

Figure 7A:
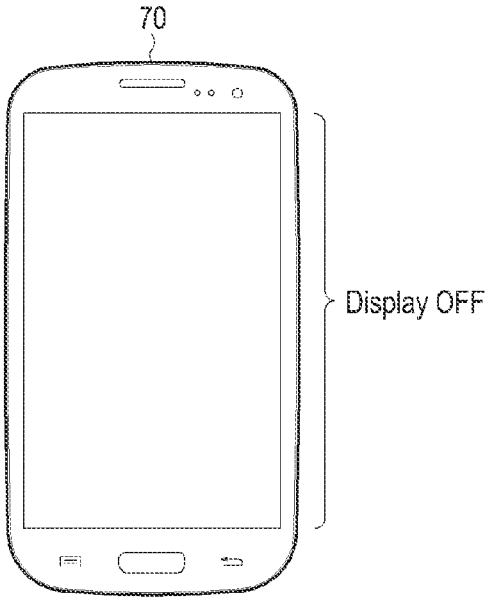
FIGS. 7A and 7B illustrate display screens in a situation where an electronic device is connected to an external device according to an example embodiment.
Figure 7B:
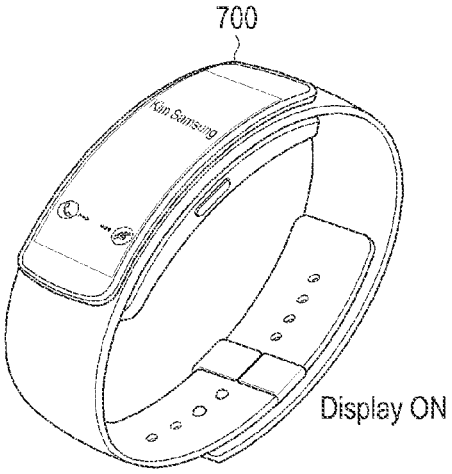

For example, when the user wears the wearable device on, for example, the wrist, if a call reception event is generated in the electronic device, the electronic device may identify the generation of the call reception event. When the electronic device receives the information indicating that the wearable device is worn by the user from the wearable device, the electronic device 70 may turn off the entire area of the display of the electronic device 70 as illustrated in FIG. 7A, and may transmit the information corresponding to the call reception event to the wearable device and display the information corresponding to the call reception event on the wearable device 700 as illustrated in FIG. 7B. Meanwhile, the wearable device may include a sensor for detecting whether the wearable device is worn by the user. The wearable device may identify whether the wearable device is worn by the user through the sensor and transmit corresponding information to the electronic device 70.

In operation 660, the electronic device may turn on only a predetermined area corresponding to the event on the display of the electronic device and display information corresponding to the event.

In operation 670, the electronic device may determine whether the electronic device receives the information indicating that the wearable device is not worn by the user from the wearable device. The electronic device may perform operation 680 when the electronic device receives the information indicating that the electronic device is not worn by the user in operation 670, and may perform operation 630 when the electronic device does not receive the information indicating that the electronic device is not worn by the user in operation 670.

In operation 680, the electronic device may turn on only the predetermined area corresponding to the event on the display of the electronic device and display information corresponding to the event.

According to an example embodiment, when the user is exercising while holding the electronic device, the electronic device may identify an exercise situation by using, for example, the GPS, the acceleration sensor, the iris recognition sensor, the proximity sensor, a temperature sensor for detecting a temperature of the electronic device, or the like and, accordingly, the electronic device may determine that the electronic device is not being used by user and turn off the entire area of the display.

According to an example embodiment, when the user is driving a car while leaving the electronic device in the car, the electronic device may determine that the electronic device is not used through, for example, the GPS and the acceleration sensor and turn off the entire area of the display. For example, when it is identified that the electronic device is moving through the GPS and the electronic device has no motion through the acceleration sensor, the electronic device may determine that the electronic device is not used and turn off the entire area of the display.

According to an example embodiment, when the user executes only a particular function of the electronic device, the electronic device may identify a situation where the electronic device executes only the particular function and turn on or off at least some areas of the display by controlling the areas of the display corresponding to the particular function. For example, when the user executes an MP3 function of the electronic device and then does not execute another function, the electronic device may determine a situation where the electronic device executes only the MP3 function, and may turn off the entire area of the display or turn on only a predetermined area of the display corresponding to the MP3 function and turn off the remaining area.

According to the above described example embodiments, the situation where the electronic device should use the entire area of the display of the electronic device, the situation where the electronic device is not required to use the entire area of the display of the electronic device, and the situation where the electronic device may use only some areas of the display of the electronic device are configured in the electronic device. When the electronic device determines that the corresponding situation occurs, the electronic device may turn on or off at least some areas of the display of the electronic device. Accordingly, it is possible to reduce an unnecessary power waste of the electronic device by efficiently controlling turning on or off of the display of the electronic device.

Figure 8:
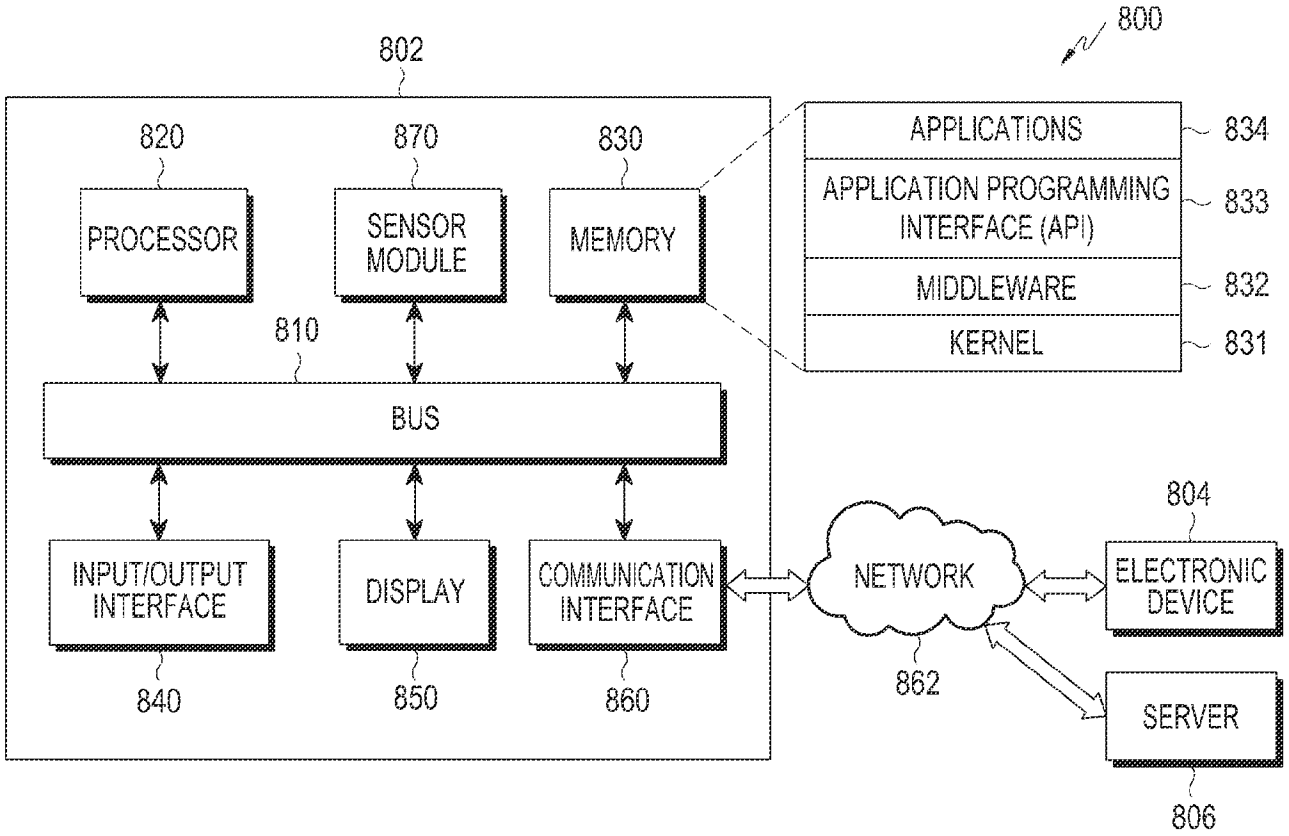
FIG. 8 is a block diagram of a network environment including an electronic device according to various example embodiments.

FIG. 8 is a block diagram of a network environment including an electronic device according to various example embodiments. Referring to FIG. 8, the electronic device 802 may include a bus 810, a processor 820, a memory 830, an input/output interface 840, a display 850, a communication interface 860, and a sensor module 870. The bus 810 may be a circuit for connecting component elements of the electronic device 802 and for transferring communication, for example, a control message, between the component elements.

The processor 820 may, for example, receive a command from other component elements, for example, the memory 830, the input/output interface 840, the display 850, the communication interface 860, the sensor module 870, and the like, through the bus 810, may decrypt the received instruction, and may execute operation or data processing based on the decrypted instruction.

The memory 830 may store a command or data received from the processor 820 or other component elements (for example, the input/output interface 840, the display 850, the communication interface 860, the sensor module 870, and the like) or may store instruction or data generated by the processor 820 or other component elements. The memory 830 may include programming modules, for example, a kernel 831, middleware 832, an Application Programming Interface (API) 833, applications 834, and the like. Each of the programming modules may be formed of software, firmware, or hardware, or any combination thereof.

The kernel 831 may control or manage system resources (for example, the bus 810, the processor 820, the memory 830, or the like) used for executing an operation or function implemented in other programming modules, for example, the middleware 832, the API 833, or the applications 834. Also, the kernel 831 may provide an interface that enables the middleware 832, the API 833, or the application 834 to access an individual component element of the electronic device 802 for control or management.

The middleware 832 may act as a relay so that the API 833 or the applications 834 communicate to exchange data with the kernel 831. Also, in association with task requests received from the application 834, the middleware 832 may execute a control (for example, scheduling or load balancing) for a task request through use of a method of assigning, to at least one of applications 834, a priority of use of a system resource of the electronic device 802 (for example, the bus 810, the processor 820, the memory 830, or the like).

The API 833 is an interface used by the application 834 to control a function provided from the kernel 831 or the middleware 832, and may include, for example, at least one interface or function (for example, an instruction) for a file control, a window control, image processing, a character control, or the like.

According to the various example embodiments, the applications 834 may include a Short Message Service (SMS)/Multimedia Message Service (MMS) application, an e-mail application, a calendar application, an alarm application, a health care application (for example, an application for measuring a work rate or a blood sugar), an environment information application (for example, an application for providing atmospheric pressure, humidity, or temperature information), or the like. Additionally or alternatively, the application 834 may be an application associated with exchanging information between the electronic device 802 and an external electronic device (for example, an electronic device 804). The application associated with exchanging information may include, for example, a notification relay application for transferring predetermined information to an external electronic device or a device management application for managing an external electronic device.

For example, the notification relay application may include a function of transferring, to the external electronic device (for example, the electronic device 804), notification information generated from other applications of the electronic device 802 (for example, an SMS/MMS application, an e-mail application, a health management application, an environmental information application, and the like). Additionally or alternatively, the notification relay application may receive notification information from, for example, an external electronic device (for example, the electronic device 804), and may provide the notification information to a user. The device management application may manage (for example, install, delete, or update), for example, a function of at least a part of an external electronic device (for example, the electronic device 804) that communicates with the electronic device 802 (for example, activating/deactivating the external electronic device (or a few component elements) or adjusting brightness (or resolution) of a display), an application operated in the external electronic device, or a service provided from the external electronic device (for example, a call service or a message service).

According to various example embodiments, the applications 834 may include an application designated based on properties (for example, a type of an electronic device) of an external electronic device (for example, the electronic device 804). For example, when the external electronic device is an MP3 player, the application 834 may include an application related to the reproduction of music. Similarly, when the external electronic device is a mobile medical device, the application 834 may include an application related to health care. According to an example embodiment, the applications 834 may include at least one of applications received from an application designated for the electronic device 802 or an application received from an external electronic device (for example, a server 806 or the electronic device 804).

The input/output interface 840 may transfer a command or data input by a user through an input/output device (for example, a sensor, a keyboard, or a touch screen) to the processor 820, the memory 830, the communication interface 860, and the sensor module 870, for example, through the bus 810. For example, the input/output interface 840 may provide, to the processor 820, data associated with a touch of a user input through a touch screen. The input/output interface 840 may output, for example, commands or data received through the bus 810 from the processor 820, the memory 830, the communication interface 860, and the sensor module 870, to an input/output device (for example, a speaker or display).

The display 850 may display various pieces of information (for example, multimedia data, text data, and the like) to a user.

The communication interface 860 may connect communication between the electronic device 802 and an electronic device (for example, the electronic device 804 or the server 806). For example, the communication interface 860 may be connected to the network 862 through wireless communication or wired communication, and may communicate with an external device. Wireless communication may include at least one of, for example, Wi-Fi, Bluetooth (BT), Near Field Communication (NFC), Global Positioning System (GPS) and cellular communication (for LTE, LTE-A, CDMA, WCDMA, UMTS, WiBro, GSM or the like). Also, the wired communication may include at least one of, for example, a Universal Serial Bus (USB), a High Definition Multimedia Interface (HDMI), Recommended Standard 232 (RS-232), and a Plain Old Telephone Service (POTS).

According to an example embodiment, the network 862 may be a telecommunication network. The telecommunication network may include at least one of a computer network, the Internet, the Internet of Things, and a telephone network. According to an example embodiment, a protocol for communication between the electronic device 802 and an external device (for example, a transport layer protocol, a data link layer protocol or a physical layer protocol) may be supported in at least one of the applications 834, the API 833, the middleware 832, the kernel 831, and the communication interface 860.

The sensor module 870 may form, for example, a part or the entirety of the sensor module 130 illustrated in FIG. 1.

Figure 9:
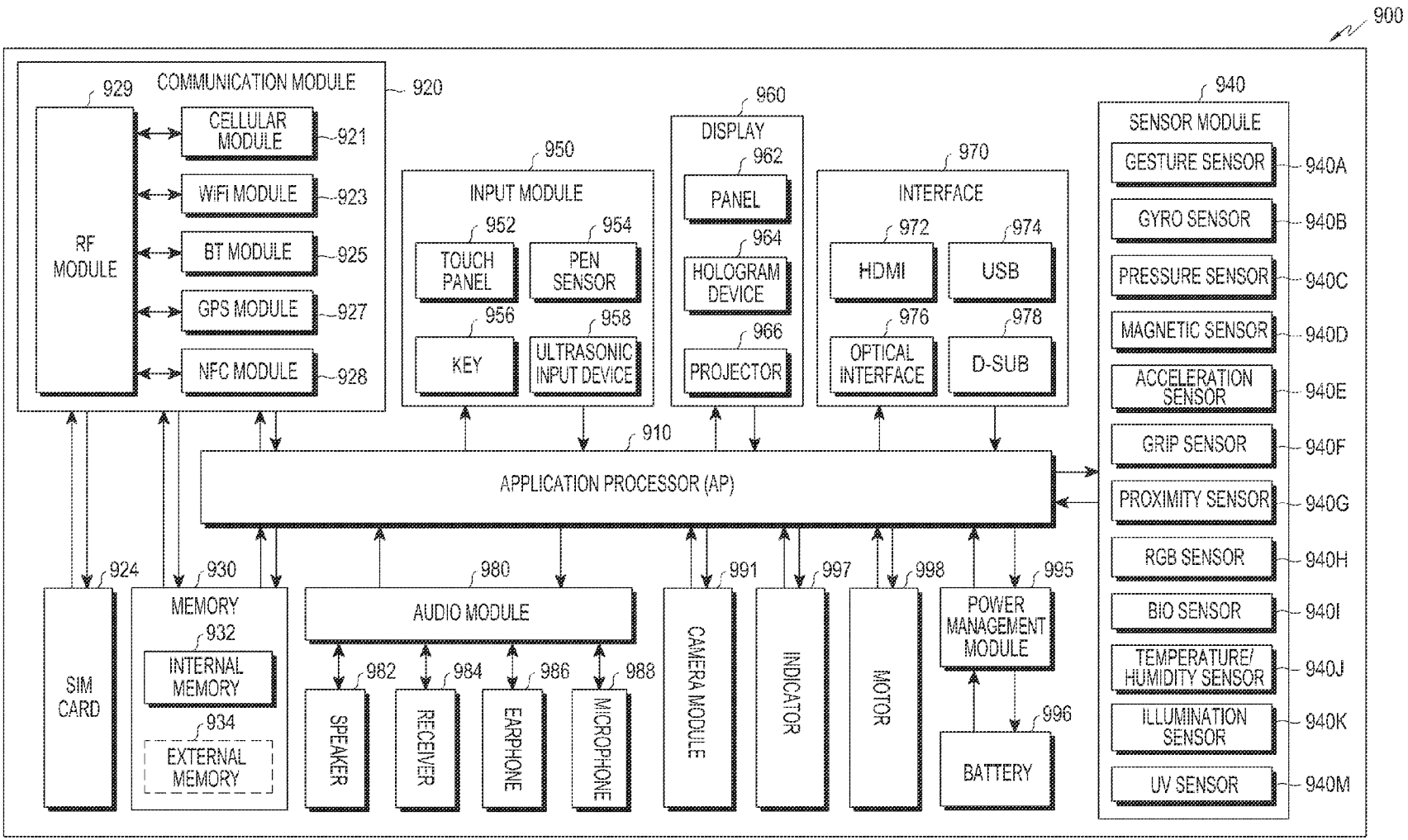
FIG. 9 is a block diagram of an electronic device according to various example embodiments.

FIG. 9 is a block diagram of an electronic device according to various example embodiments. The electronic device 900 may form, for example, a part or the entirety of the electronic device 900 illustrated in FIG. 9. Referring to FIG. 9, the electronic device 900 may include at least one Application Processor (AP) 910, a communication module 920, a Subscriber Identifier Module (SIM) card 924, a memory 930, a sensor module 940, an input module 950, a display 960, an interface 970, an audio module 980, a camera module 991, a power management module 995, a battery 996, an indicator 997, and a motor 998.

The AP 910 may control a plurality of hardware or software elements connected thereto by driving an operating system or an application program, process various types of data including multimedia data, and perform calculations. The AP 910 may be embodied as, for example, a System on Chip (SoC). According to an example embodiment, the AP 910 may further include a Graphic Processing Unit (GPU).

The communication module 920 (for example, the communication interface 860) may transmit and receive data during communication between the electronic device (for example, the electronic device 900) and other electronic devices (for example, the electronic device 804, the server 806, or a social search engine) connected over a network. According to an example embodiment, the communication module 920 may include a cellular module 921, a Wi-Fi module 923, a BT module 925, a GPS module 927, an NFC module 928, and a Radio Frequency (RF) module 929.

The cellular module 921 may provide a voice call, a video call, a text message service, an Internet service, or the like through a communication network (for example, LTE, LTE-A, CDMA, WCDMA, UMTS, WiBro, GSM, or the like). Also, the cellular module 921 may identify and authenticate an electronic device in a communication network using, for example, a subscriber identification module (for example, the SIM card 924). According to an example embodiment, the cellular module 921 may perform at least some of functions that the AP 910 may provide. For example, the cellular module 921 may perform at least a part of the multimedia control function.

According to an example embodiment, the cellular module 921 may include a Communication Processor (CP). Furthermore, the cellular module 921 may be implemented by, for example, an SoC. Although the components such as the cellular module 921 (for example, communication processor), the memory 930, and the power management module 995 are illustrated as components separate from the AP 910 in FIG. 9, the AP 910 may include at least some of the above-described components (for example, the cellular module 921) according to an example embodiment.

According to an example embodiment, the AP 910 or the cellular module 921 (for example, the communication processor) may load commands or data received from at least one of a non-volatile memory and other components connected thereto in a volatile memory and process the loaded commands or data. Furthermore, the AP 910 or the cellular module 921 may store, in a non-volatile memory, data received from or generated by at least one of the other component elements.

Each of the Wi-Fi module 923, the BT module 925, the GPS module 927, or the NFC module 928 may include, for example, a processor for processing data transmitted/received through a corresponding module. Although the cellular module 921, the Wi-Fi module 923, the BT module 925, the GPS module 927, and the NFC module 928 are illustrated as individual blocks in FIG. 9, at least some (for example, two or more) of the cellular module 921, the Wi-Fi module 923, the BT module 925, the GPS module 927, and the NFC module 928 may be included within one Integrated Chip (IC) or one IC package. For example, at least some (for example, the communication processor corresponding to the cellular module 921 and the Wi-Fi processor corresponding to the Wi-Fi module 923) of processors corresponding to the cellular module 921, the Wi-Fi module 923, the BT module 925, the GPS module 927, and the NFC module 928 may be implemented as one SoC.

The RF module 929 may transmit/receive data, for example, an RF signal. Although not illustrated, the RF module 929 may include, for example, a transceiver, a Power Amp Module (PAM), a frequency filter, a Low Noise Amplifier (LNA), or the like. Further, the RF module 929 may further include a component for transmitting/receiving an electromagnetic wave in the air in radio communication, such as a conductor or a conducting wire. Although the cellular module 921, the Wi-Fi module 923, the BT module 925, the GPS module 927, and the NFC module 928 are illustrated to share one RF module 929 in FIG. 9, at least one of the cellular module 921, the Wi-Fi module 923, the BT module 925, the GPS module 927, and the NFC module 928 may transmit/receive the RF signal through a separate RF module.

The SIM card 924 may be a card including a subscriber identification module and may be inserted into a slot formed in a particular portion of the electronic device. The SIM card 924 may include unique identification information (for example, an Integrated Circuit Card IDentifier (ICCID)) or subscriber information (for example, an International Mobile Subscriber IDentity (IMSI)).

The memory 930 may include an internal memory 932 or an external memory 934. The internal memory 932 may include at least one of a volatile memory (for example, a Dynamic Random Access Memory (DRAM), a Static RAM (SRAM), a Synchronous Dynamic RAM (SDRAM), and the like) and a non-volatile memory (for example, a One Time Programmable Read Only Memory (OTPROM), a Programmable ROM (PROM), an Erasable and Programmable ROM (EPROM), an Electrically Erasable and Programmable ROM (EEPROM), a mask ROM, a flash ROM, a NAND flash memory, a NOR flash memory, and the like).

According to an example embodiment, the internal memory 932 may be a Solid State Drive (SSD). The external memory 934 may further include a flash drive, for example, a Compact Flash (CF), a Secure Digital (SD), a Micro Secure Digital (Micro-SD), a Mini Secure Digital (Mini-SD), an extreme Digital (xD), a memory stick, or the like. The external memory 934 may be functionally connected to the electronic device 900 through various interfaces. According to an example embodiment, the electronic device 900 may further include a storage device (or storage medium) such as a hard drive.

The sensor module 940 may measure a physical quantity or detect an operating state of the electronic device 900, and convert the measured or detected information into an electronic signal. The sensor module 940 may include, for example, at least one of a gesture sensor 940A, a gyro sensor 940B, an atmospheric pressure sensor 940C, a magnetic sensor 940D, an acceleration sensor 940E, a grip sensor 940F, a proximity sensor 940G, a color sensor 940H (for example, red, green, and blue (RGB) sensor), a biometric sensor 940I, a temperature/humidity sensor 940J, an illumination sensor 940K, and an Ultra Violet (UV) sensor 940M. Additionally or alternatively, the sensor module 940 may include, for example, an E-nose sensor (not illustrated), an electromyography (EMG) sensor (not illustrated), an electroencephalogram (EEG) sensor (not illustrated), an electrocardiogram (ECG) sensor (not illustrated), an Infrared (IR) sensor, an iris sensor (not illustrated), a fingerprint sensor, and the like. The sensor module 940 may further include a control circuit for controlling at least one sensor included therein.

The input device 950 may include a touch panel 952, a (digital) pen sensor 954, a key 956, or an ultrasonic input device 958. The touch panel 952 may recognize a touch input through at least one of, for example, a capacitive type, a resistive type, an infrared type, and an ultrasonic type. The touch panel 952 may further include a control circuit. In the case of the capacitive type, physical contact or proximity recognition is possible. The touch panel 952 may further include a tactile layer. In this case, the touch panel 952 may provide a tactile reaction to a user.

The (digital) pen sensor 954 may be implemented, for example, using a method that is the same as or similar to receiving a user's touch input, or using a separate recognition sheet. The key 956 may include, for example, a physical button, an optical key or a keypad. The ultrasonic input device 958 is a unit that may identify data by generating an ultrasonic signal through an input tool and detecting a sonic wave through a microphone (for example, a microphone 988) in the electronic device 900, and is capable of wireless recognition. According to an example embodiment, the electronic device 900 may also receive a user input from an external device (for example, a computer or server) connected thereto, using the communication module 920.

The display 960 (for example, display 850) may include a panel 962, a hologram device 964, or a projector 966. The panel 962 may be, for example, a Liquid Crystal Display (LCD), Active-Matrix Organic Light Emitting Diode (AM-OLED), or the like. The panel 962 may be implemented to be, for example, flexible, transparent, or wearable. The panel 962 may also be integrated with the touch panel 952 as a single module. The hologram device 964 may show a stereoscopic image in the air using interference of light. The projector 966 may project light onto a screen to display an image. For example, the screen may be located inside or outside the electronic device 900. According to an example embodiment, the display 960 may further include a control circuit for controlling the panel 962, the hologram device 964, or the projector 966.

The interface 970 may include, for example, a High-Definition Multimedia Interface (HDMI) 972, a Universal Serial Bus (USB) 974, an optical interface 976, or a D-sub-miniature (D-sub) 978. Additionally or alternatively, the interface 970 may include, for example, a Mobile High-definition Link (MHL) interface, a Secure Digital (SD) card/Multi-Media Card (MMC) interface, or an Infrared Data Association (IrDA) standard interface.

The audio module 980 may bilaterally convert a sound and an electrical signal. The audio module 980 may process voice information input or output through, for example, a speaker 982, a receiver 984, earphones 986, or the microphone 988.

The camera module 991 is a device which may photograph a still image and a video. According to an example embodiment, the camera module 991 may include one or more image sensors (for example, a front sensor or a rear sensor), a lens (not illustrated), an Image Signal Processor (ISP) (not illustrated) or a flash (not illustrated) (for example, an LED or xenon lamp).

The power management module 995 may manage electric power of the electronic device 900. Although not illustrated, the power management module 995 may include, for example, a Power Management Integrated Circuit (PMIC), a charger Integrated Circuit (IC), or a battery or fuel gauge.

The PMIC may be mounted, for example, in integrated circuits or SoC semiconductors. The charging methods may be classified into wired charging and wireless charging. The charger IC may charge a battery and prevent inflow of excessive voltage or excessive current from a charger. According to an example embodiment, the charger IC may include a charger IC for at least one of the wired charging method and the wireless charging method. Examples of the wireless charging may include magnetic resonance charging, magnetic induction charging, and electromagnetic charging, and an additional circuit such as a coil loop, a resonance circuit, a rectifier or the like may be added for the wireless charging.

The battery gauge may measure, for example, a residual quantity of the battery 996, a voltage, a current, or a temperature during charging. The battery 996 may store or generate electricity and supply power to the electronic device 900 using the stored or generated electricity. The battery 996 may include, for example, a rechargeable battery or a solar battery.

The indicator 997 may indicate particular states (for example, a booting state, a message state, a charging state, etc.) of the electronic device 900 or a part (for example, the AP 910) of the electronic device 900. The motor 998 may convert an electrical signal into mechanical vibration. Although not illustrated, the electronic device 900 may include a processing device (for example, a GPU) for supporting a mobile TV. The processing device for supporting the mobile TV may process media data according to standards, for example, a digital multimedia broadcasting (DMB), a digital video broadcasting (DVB), a media flow, or the like.

The above described components of the electronic device according to various example embodiments may be formed of one or more components, and a name of a corresponding component element may be changed based on the type of electronic device. The electronic device according to the present disclosure may include one or more of the aforementioned components or may further include other additional components, or some of the aforementioned components may be omitted. Further, some of the components of the electronic device according to the various example embodiments may be combined to form a single entity, and thus, may equivalently execute functions of the corresponding elements prior to the combination.

The "module" used in various example embodiments may refer to, for example, a "unit" including one of hardware, software, and firmware, or a combination of two or more of the hardware, software, and firmware. The "module" may be interchangeable with a term, such as a unit, a logic, a logical block, a component, or a circuit. The module may be a minimum unit of an integrated component element or a part thereof. The "module" may be the smallest unit that performs one or more functions or a part thereof. The module may be mechanically or electronically implemented. For example, the "module" according to various example embodiments may include at least one of an Application-Specific Integrated Circuit (ASIC) chip, a Field-Programmable Gate Arrays (FPGAs), and a programmable-logic device for performing operations which have been known or are to be developed hereafter.

According to various example embodiments, at least a part of a device (for example, modules or functions thereof) or a method (for example, operations) according to the various example embodiments may be embodied by, for example, a command stored in a computer readable storage medium in a form of a programming module. When the command is executed by one or more processors, the one or more processors may perform a function corresponding to the command. The computer-readable storage medium may be, for example, the memory 260. At least some of the programming modules may be implemented (for example, executed) by, for example, the processor. At least a part of the programming module may, for example, include a module, a program, a routine, a set of instructions, or a process for performing at least one function.

The computer readable recording medium may include magnetic media such as a hard disc, a floppy disc, and a magnetic tape, optical media such as a compact disc read only memory (CD-ROM) and a digital versatile disc (DVD), magneto-optical media such as a floptical disk, and hardware devices specifically configured to store and execute program commands, such as a read only memory (ROM), a random access memory (RAM), and a flash memory. In addition, the program instructions may include high class language codes, which can be executed in a computer by using an interpreter, as well as machine codes made by a compiler. The aforementioned hardware device may be configured to operate as one or more software modules in order to perform the operation of various example embodiments, and vice versa.

Example embodiments provided in the present specifications and drawings are merely certain examples to readily describe the technology associated with example embodiments and to help understanding of the example embodiments, but may not limit the scope of the example embodiments.

Therefore, in addition to the example embodiments disclosed herein, the scope of the various example embodiments should be construed to include all modifications or modified forms drawn based on the technical idea of the various example embodiments.

It will be appreciated that the example embodiments may be implemented in a form of hardware, software, a combination of hardware and software. Regardless of being erasable or re-recordable, such an optional software may be stored in a non-volatile storage device such as a ROM, a memory such as an RAM, a memory chip, a memory device, or an integrated circuit, or a storage medium such as a CD, a DVD, a magnetic disc, or a magnetic tape that is optically or electromagnetically recordable and readable by a machine, for example, a computer. It is appreciated that the storage unit included in the electronic device is one example of the machine-readable storage media suitable for storing a program or programs including commands for implementing various example embodiments. Accordingly, the present disclosure includes a program that includes a code for implementing an apparatus or a method defined in any claim in the present specification and a machine-readable storage medium that stores such a program. Further, the program may be electronically transferred by a predetermined medium such as a communication signal transferred through a wired or wireless connection, and the present disclosure appropriately includes equivalents of the program.

What is claimed is:

1. A method of controlling a display of an electronic device, comprising:

determining, by the electronic device, a current situation of the electronic device using at least one piece of information of the electronic device, the at least one piece of information including at least one of state information of the electronic device or surrounding information of the electronic device;

turning on or off at least some areas of the display based on the current situation determined by the electronic device;

wherein determining the current situation of the electronic device comprises determining whether the electronic device is connected to a wearable device when an event is generated in the electronic device, and wherein the turning on or off of the at least some areas of the display comprises:

when it is determined that the electronic device is connected to the wearable device, receiving, from the wearable device, information as to whether the wearable device is being worn;

turning off an entire area of the display based on the electronic device receiving information indicating that the wearable device is being worn by a user; and turning on a predetermined area of the display corresponding to the event while another area of the display remains off, based on determining that the electronic device is not connected to the wearable device.

2. The method of claim 1, wherein the at least one piece of information includes at least one piece of surrounding illumination information of the electronic device, information on a proximity degree of an object approaching the electronic device, position information of the electronic device, or motion information of the electronic device collected through at least one sensor of the electronic device.

3. The method of claim 1, wherein determining the current situation of the electronic device comprises determining whether the electronic device is being used based on the at least one piece of information, and the turning on or off of the at least some areas of the display comprises turning off an entire area of the display when it is determined that the electronic device is not being used.

4. The method of claim 3, further comprising: determining that the electronic device is not being used when it is determined that a surrounding illumination of the electronic device is lower than predetermined reference illumination and it is determined that there is no motion of the electronic device based on motion information of the electronic device.

5. The method of claim 1, further comprising, the electronic device transmitting information on the event to the wearable device to display the information corresponding to the event on the wearable device when the electronic device receives information indicating that the wearable device is being worn.

6. The method of claim 1, further comprising, turning on only the predetermined area of the display of the electronic device corresponding to the event and displaying information corresponding to the event in the turned on area when the electronic device receives information indicating that the wearable device is not being worn.

7. An electronic device comprising:

a display;

a sensor configured to detect at least one piece of information including at least one piece of state information of the electronic device or surrounding information of the electronic device; and a controller configured to determine a current situation of the electronic device using the at least one piece of the information detected by the sensor and to turn on or off at least some areas of the display based on the current situation, wherein the controller is configured to:

determine whether the electronic device is connected to a wearable device when an event is generated in the electronic device, when it is determined that the electronic device is connected to the wearable device, receive, from the wearable device, information as to whether the wearable device is being worn, turn off an entire area of the display based on the electronic device having received information indicating that the wearable device is being worn by a user, and turn on a predetermined area of the display corresponding to the event while another area of the display remains off, based on it having been determined that the electronic device is not connected to the wearable device.

8. The electronic device of claim 7, wherein the sensor includes at least one of an illumination sensor for detecting surrounding illumination of the electronic device, a proximity sensor for detecting proximity of an object approaching the electronic device, an acceleration sensor for determining acceleration of the electronic device, an iris recognition sensor for recognizing an iris, or a GPS receiver for determining a position of the electronic device.

9. The electronic device of claim 7, wherein the controller is configured to determine whether the electronic device is being used based on the at least one piece of the information, and to turn off an entire area of the display when it is determined that the electronic device is not being used.

10. The electronic device of claim 9, wherein the sensor includes an illumination sensor for detecting surrounding illumination of the electronic device and an acceleration sensor for determining acceleration of the electronic device, and the controller is configured to determine that the electronic device is not being used when it is determined that the surrounding illumination of the electronic device detected through the illumination sensor is lower than predetermined reference illumination and it is determined that there is no motion of the electronic device based on an output of the acceleration sensor.

11. The electronic device of claim 7, further comprising wireless communication circuitry, wherein, when the electronic device receives information indicating that the wearable device is being worn from the wearable device through the wireless communication circuitry, the controller is configured to transmit information on the event to the wearable device through the wireless communication circuitry and to display the information corresponding to the event on the wearable device.

12. The electronic device of claim 7, further comprising wireless communication circuitry, wherein, when the electronic device receives information indicating that the wearable device is not being worn from the wearable device through the wireless communication circuitry, the controller is configured to turn on only a predetermined area of the display of the electronic device corresponding to the event and to display information corresponding to the event in the turned on area.

13. The electronic device of claim 7, wherein the controller is configured to turn on the predetermined area of the display corresponding to the event while the another area of the display remains off, based on determining that the electronic device is not connected to the wearable device, comprises turning on first and second regions of the display while a central area of the display located between the first and second regions remains off.

14. The method of claim 1, wherein the turning on the predetermined area of the display corresponding to the event while the another area of the display remains off, is based on determining that the electronic device is not connected to the wearable device, and comprises turning on first and second regions of the display while a central area of the display located between the first and second regions remains off.

* * * * *